United States Patent [19]

Bostyn

[11] Patent Number: 4,892,120

[45] Date of Patent: Jan. 9, 1990

[54] APPARATUS FOR REGULATING THE JAW OF THE CUTTING RAILS IN FACE-TO-FACE WEAVING LOOMS

[75] Inventor: Roger Bostyn, Kortrijk/Marke, Belgium

[73] Assignee: N.V. Michael Van de Weile, Kortrijk/Marke, Belgium

[21] Appl. No.: 254,820

[22] Filed: Oct. 7, 1988

[30] Foreign Application Priority Data

Oct. 10, 1987 [BE] Belgium ..... 01167

[51] Int. Cl.[4] ..... D03D 39/18

[52] U.S. Cl. ..... 139/21; 139/291 C

[58] Field of Search ..... 139/21, 291 C; 26/14; 156/254

[56] References Cited

U.S. PATENT DOCUMENTS 3,406,725 10/1968 Hastewell et al. ..... 139/21
4,478,255 10/1984 Juillard ..... 139/21

FOREIGN PATENT DOCUMENTS 3240393 7/1983 Fed. Rep. of Germany ..... 139/21
2493355 5/1982 France .
2562566 10/1985 France .

*Primary Examiner*—Henry S. Jaudon
*Attorney, Agent, or Firm*—James Creighton Wray

[57] ABSTRACT

Cutting device to spilt a face-to-face woven fabric provided with one or more electronic displacement transducers (11, 12) which produce a signal proportional to the position of the top cutting rail (4) and bottom cutting rail (5) of the cutting device respectively in relation to the knife blade (6) of the cutting device, provided with one or more adjusting spindles (13, 14) driven by an electric motor (15) for adjusting the height of the cutting rails (4, 5), and provided with a processor unit (24) to which a keyboard and display (25) are connected and which serves to control the electric motors (15) on the basis of the input data and the measurement data.

12 Claims, 2 Drawing Sheets

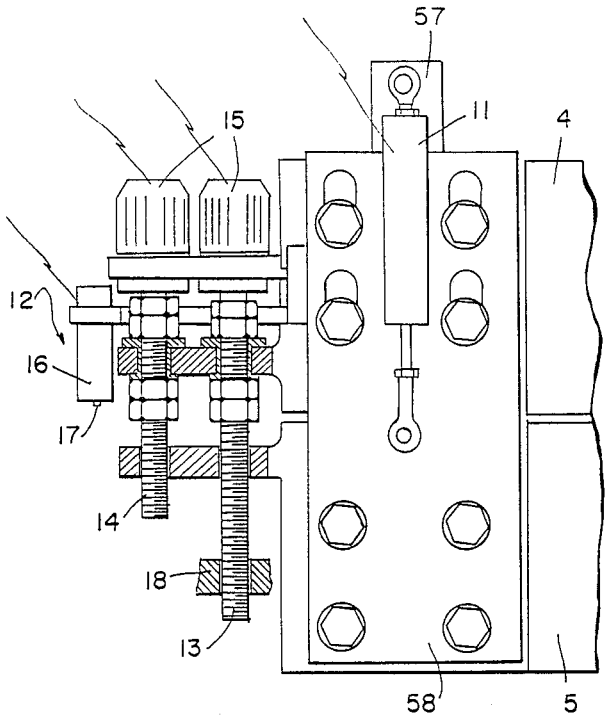
FIG. 2
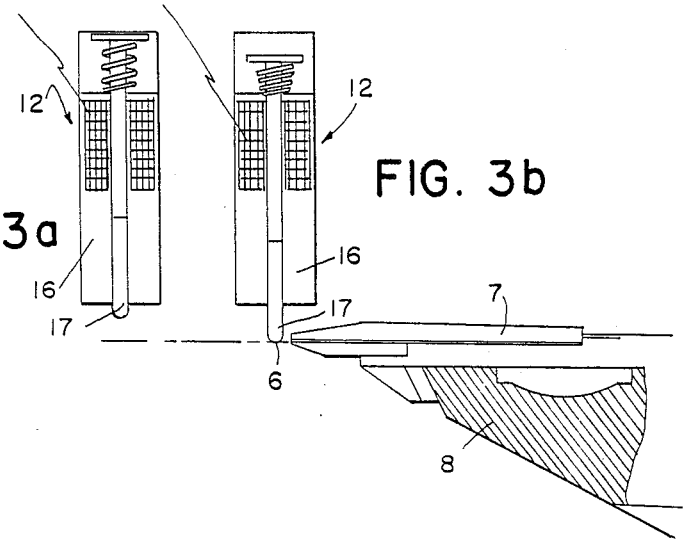
FIG. 3a
FIG. 3b

APPARATUS FOR REGULATING THE JAW OF THE CUTTING RAILS IN FACE-TO-FACE WEAVING LOOMS

BACKGROUND OF THE INVENTION

The present invention relates to the cutting device which splits a face-to-face woven pile fabric into a top and bottom pile fabric.

The present invention deals more particularly with the components of a cutting device of this kind which determine the opening between the top and bottom cutting rails and the vertical position of the cutter blade in relation to the two cutting rails.

In face-to-face weaving the height of the pile of the woven fabric is determined by various parameters. The most important of these parameters are the following: the ratio of the feed speed of the pile warp threads to the feed speed of the warp threads, the tension on the warp threads, and the adjustment of the jaw, that is to say the height of the opening between the bottom and top cutting rails through which the unseparated face-to-face fabric is guided to the knife blade. If the adjustment of the jaw is not in conformity with the other parameters which also determine the height of the pile, the resulting fabric is of inferior quality.

On the other hand, the equal pile height of the split fabrics is determined, in addition to other parameters, by the positioning of the top and bottom cutting rails in relation to the fixed cutting bank. The top and bottom cutting rails must be disposed in such a manner that the line followed by the tip of the knife blade during the movement of the knife carriage is situated exactly in the middle between and parallel to the two cutting rails. If this requirement is not met, the height of the pile may be different in each of the pile fabrics produced and/or may vary over the width of the resulting pile fabrics.

Up to the present time the bottom and top cutting rails have been adjusted manually with the aid of set screws and adjusting nuts. Adjustment can be made only by a trial and error method and can be checked only by weaving a few meters, measuring the pile height of the two pile fabrics produced at a number of points and, if the pile heights are not equal, amending the adjustment of the two cutting rails. This procedure must sometimes be repeated several times before the correct adjustment is obtained. Not only did this mean spending a considerable time on adjustment, but also resulted in the production of many meters of second grade pile fabric.

SUMMARY OF THE INVENTION

The present invention seeks to improve the cutting device in face-to-face weaving looms so that the two cutting rails can be adjusted quickly and correctly.

The cutting device according to the invention is on the one hand characterized in that it is provided with one or more electronic displacement transducers which produce a signal proportional to the position of the top and bottom cutting rails respectively in relation to the knife blade.

The cutting device according to the invention is on the other hand characterized in that one or more adjusting spindles driven by an electric motor acts or act on each of the cutting rails.

In addition, the cutting device according to the invention is provided with a processor unit to which a screen displaying data and a keyboard for inputting data are connected, which processor unit receives measurement data from the electronic displacement transducers and controls the electric motors of the adjusting spindles on the basis of the data input via the keyboard in connection with the desired position of the cutting rails and on the basis of the measurement data, so that the desired position of the cutting rails is obtained.

Further details of the cutting device according to the invention will emerge from the following description of a preferred form of construction, indicated without in any way constituting a limitation, of the cutting device according to the invention. This description refers to the accompanying drawings.

BRIEF DESCRIPTION OF THE DRAWINGS

FIG. 2 is a rear view of one end of the two cutting rails.

FIGS. 3*a* and 3*b* are schematic sections of the displacement transducer which makes measurements in relation to the knife blade, FIG. 3*a* showing the position of rest and FIG. 3*b* the measuring position.

FIG. 4 is a diagram of the processor unit of the cutting device according to the invention.

DETAILED DESCRIPTION OF THE DRAWINGS

Figure 1:
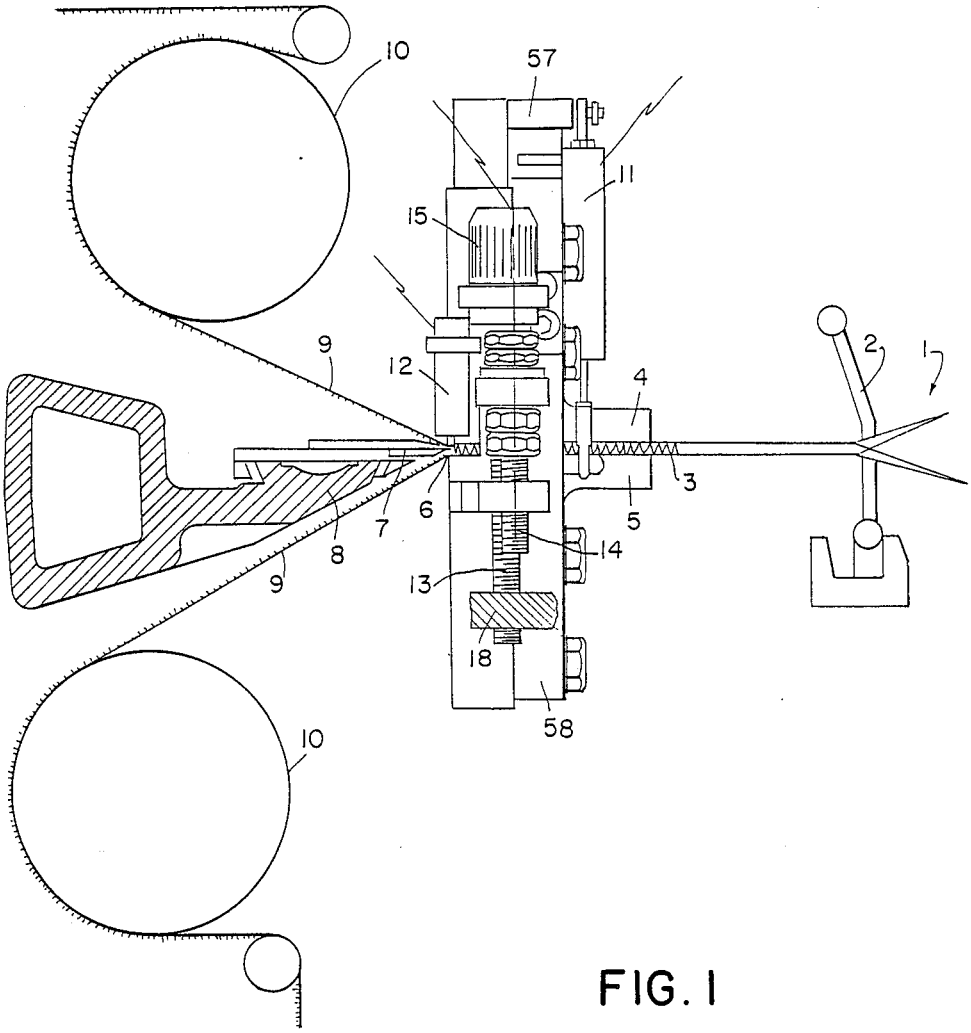
FIG. 1 is a side view of the two cutting rails and the cutting bank, the reed and the face-to-face weaving loom being indicated schematically.

In double weaving the pile warp and backing warp threads 1 (FIG. 1) are formed at the fabric forming edge—symbolized by the reed 2 in the beating-up position—together with the weft threads into an unseparated face-to-face fabric 3. This unseparated double fabric 3 consists of two parallel backing fabrics connected together by pile-forming pile warp threads. The cutting device of a face-to-face weaving loom splits this fabric into two separate pile fabrics 9 which are taken up by separated spike rollers 10. A cutting device of this kind always consists of the cutting bank 8, over which a knife carriage 7 carrying a knife blade 6 moves to-and-fro. Two cutting rails, namely the top and bottom cutting rails 4 and 5 respectively, are disposed opposite the cutting bank, lying parallel to one another. An opening, the so-called "jaw", lies between the two cutting rails 4 and 5. The cutting rails 4 and 5 serve to guide the unseparated face-to-face fabric 3 towards the knife blade. In order to obtain two pile fabrics 9 having the same, constant pile height, the cutting rails 4 and 5 must be so positioned that the distance between them corresponds to the desired pile height and that they lie parallel and at the same distance from the path of the moving knife blade tip.

In the cutting device according to the invention the top and bottom cutting rails 4 and 5 are provided on the one hand with electronic displacement transducers 11 and 12 and on the other hand with adjusting spindles 13 and 14 driven by electric motors 15 (FIGS. 1 and 2). The displacement transducers 11 and 12 and the electric motors 15 of the adjusting spindles 13 and 14 are coupled together by a processor unit (FIG. 4).

The displacement transducers 11 and 12 produce signals which are proportional to the position of each of the cutting rails 4 and 5 in relation to the knife blade. In the embodiment illustrated in FIGS. 1 and 2 the displacement transducers 11 are disposed between the ends of each of the cutting rails 4 and 5. The top end of transducer 11 is fixed to the top cutting rail 4 by means of bracket 7. The bottom end of transducer 11 is fixed to connecting plate 58, which in turn is fixed to the bottom of cutting rail 5. Transducer 12 is fixed by its casing to an extension of top cutting rail 4. These displacement transducers 11 thus provide a signal proportionate to the position of the two cutting rails 4 and 5 in relation to one another, or thus to the size of the jaw. The displacement transducer 12 is fastened by its casing 16 against one end of, for example, the top cutting rail 4. The movable core 17 (FIG. 3) of the displacement transducer has two positions: a rest position (FIG. 3*a*) and a measuring position (FIG. 3*b*). The movable core 17 is held by the action of a spring in its rest position and is pressed into its measuring position, against the upper side of the temporarily stationary knife blade 6, by the temporary action of an electromagnet. The displacement transducer 12 thus provides a signal which is proportional to the position of the top cutting rail 4 in relation to the knife blade 6.

The principle of the displacement transducers 11 and 12 is preferably based on a transformer action, whereby a sinusoidal signal is transmitted in the primary via a modulator and the coupling to the secondary windings is determined by the position of a displaceable core. A linear output signal dependent on the position of the core is obtained via an amplifier and a modulator.

The adjusting spindles 14 cooperate with a screwthread fastened to the ends of the bottom cutting rail 5 and bear against the ends of the top cutting rail 4 via an axial bearing 19. The adjusting spindles 14 thus regulate the size of the jaw. The adjusting spindles 13 cooperate with a screw thread fastened to the frame 18 of the weaving loom and bear against the ends of the top cutting rail 4 via an axial bearing 19. The adjusting spindles 13 thus regulate the position of the jaw relative to the knife blade 6. Each of the adjusting spindles is driven by an electric motor 15 controlled from a processor unit.

In FIG. 4 the displacement transducers 11 at each end of the cutting rails 4 and 5, the displacement transducer 12 provided at one end of the cutting rails 4 and 5 and the electric motors 15 for each of the pairs of adjusting spindles 13 and 14 are shown. The measurement signals from the displacement transducers 11 and 12 are converted in an interface 20 into one digital signal via a filter 21, a multiplexer 22, and an analog/digital converter 23. This signal is fed to the processor unit 24, to which a keyboard and display 25 are also connected. The processor unit 24 controls the electric motors 15 via a buffer 26 and also controls the core 17 of the displacement transducer 12 to move from its position of rest to its measuring position. On the basis of the data input via the keyboard 25 regarding the desired position and size of the jaw, and on the basis of the measurement data received via the displacement transducers 11 and 12 regarding the position and size of the jaw, the processor unit controls the electric motors 15. It may then be necessary for the adjusting spindles 13, which position the jaw in relation to the knife blade 6 and thus in relation to the frame, to be provided with a subsidiary measuring device supplying data regarding the position of the jaw in relation to the frame, because the knife blade 6 is not an absolute reference point in view of the spring mounting of the cutting carriage 7. These data can then be fed to the processor unit 24 as shown in FIG. 4.

It is obvious that each of the two cutting rails 4 and 5 may be provided with its own pair of adjusting spindles for adjustment in relation to the frame, which pairs of spindles can then be adjusted relative to the frame independently of one another, and that the position of the ends of each of the cutting rails 4 and 5 in relation to the frame can be monitored by individual displacement transducers, so that with a known position of the cutter blade relative to the frame the processor unit can control the electric motors of the adjusting spindles. A less elaborate embodiment of the invention is not provided with controlled electric motors on the adjusting spindles and requires manual adjustment of the cutting rails 4 and 5 on the basis of the continuous measurement of the size and position of the jaw with the aid of the apparatus according to the invention.

The apparatus according to the invention enables the position and size of the jaw to be monitored continuously, even during weaving. When the weaving loom is changed over to a different product, the jaw can be rapidly adapted and adjusted in a simple manner.

I claim:

1. Cutting device to split a face-to-face woven fabric, consisting of a fixed cutting bank (8) over which a knife carriage (7) provided with a knife blade (6) moves to-and-fro, and of a top cutting rail (4) and a bottom cutting rail (5), both of which are arranged for vertical adjustment in relation to the knife blade (8), and which respectively form top and bottom guides for the unsplit face-to-face fabric (3), characterized in that the cutting device is provided with at least one electronic displacement transducer which produces a signal proportional to the position of the top and bottom cutting rails (4, 5) respectively in relation to the knife blade.

2. Cutting device according to claim 1, characterized in that the electronic displacement transducer is disposed between the ends of the cutting rails.

3. Cutting device according to claim 1, further characterized in that at least one additional electronic displacement transducer is disposed between the top cutting rail and a fixed reference point on a weaving loom.

4. Cutting device according to claim 3, characterized in that the fixed reference point is an upper side of the knife blade (6).

5. Cutting device according to claim 3, characterized in that the fixed reference point is a lower side of the knife blade.

6. Cutting device according to claim 1, further characterized in that at least one adjusting spindle driven by an electric motor (15) acts on each of the cutting rails (4, 5).

7. Cutting device according to claim 6, characterized in that the adjusting spindle engages with a screw thread fastened to a frame (18) of a weaving loom and cooperate with an axial bearing (19) in an end of one of of the cutting rails (4, 5).

8. Cutting device according to claim 6, characterized in that the adjusting spindle engages with a screw thread in an end of one of of the cutting rails (4, 5) and cooperate with an axial bearing (19) fastened to the frame (18) of the weaving loom.

9. Cutting device according to claim 6, characterized in that there are at least two adjusting spindles, wherein a first adjusting spindle (14) bears against one of the cutting rails and cooperates with a screw thread provided respectively in the other cutting rail, and that a second adjusting spindle (13) bears against components fastened to a frame (18) of the weaving loom and cooperates with a screw thread which is provided respectively in an end of one of the cutting rails.

10. Cutting device according to claim 6, provided with a processor unit (24) to which means (25) for inputting and displaying data are connected, and which receives measurement data from the electronic displacement transducers and controls electric motors of adjusting spindles on the basis of data input by the input means regarding a desired position of the cutting rails and on the basis of the measurement data, so that the desired position of the cutting rails is obtained.

11. The cutting device according to claim 6, further characterized in that there are at least two adjusting spindles, wherein a first adjusting spindle bears against one of the cutting rails and cooperates with a screw thread provided respectively in the other cutting rail, and that a second adjusting spindle bears against one of the cutting rails and cooperates with a screw thread which is provided respectively in components fastened to the frame of the weaving loom.

12. Cutting device according to claim 1, further characterized in that at least one additional electronic displacement transducer is disposed between the bottom cutting rail and a fixed reference point on a weaving loom.

* * * * *